US011912484B2

(12) United States Patent
Gonzalez Manzano

(10) Patent No.: US 11,912,484 B2
(45) Date of Patent: Feb. 27, 2024

(54) CARTON FOR CONTAINERS

(71) Applicant: Graphic Packaging International, LLC, Atlanta, GA (US)

(72) Inventor: Ana Maria Gonzalez Manzano, Igualada (ES)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/322,032

(22) Filed: May 17, 2021

(65) Prior Publication Data

US 2021/0362926 A1 Nov. 25, 2021

Related U.S. Application Data

(60) Provisional application No. 63/028,628, filed on May 22, 2020.

(51) Int. Cl.
*B65D 71/36* (2006.01)
*B65B 21/24* (2006.01)

(52) U.S. Cl.
CPC ..... *B65D 71/36* (2013.01); *B65B 21/242* (2013.01); *B65D 2571/0066* (2013.01);
(Continued)

(58) Field of Classification Search
CPC ..... B65D 71/36; B65D 2571/00141; B65D 2571/00462; B65D 2571/00561;
(Continued)

(56) References Cited

U.S. PATENT DOCUMENTS 1,253,193 A 1/1918 Hill
2,383,183 A 8/1945 Fishcher
(Continued)

FOREIGN PATENT DOCUMENTS

CA 877792 8/1971
CA 1 243 987 11/1988
(Continued)

OTHER PUBLICATIONS

International Search Report and Written Opinion for PCT/US2021/032717 dated Aug. 25, 2021.
(Continued)

*Primary Examiner* — J. Gregory Pickett
*Assistant Examiner* — Jenine Pagan
(74) *Attorney, Agent, or Firm* — Womble Bond Dickinson (US) LLP

(57) ABSTRACT

A carton for containing a plurality of containers includes a bottom panel, at least one top panel, at least one side panel, at least one top end flap foldably connected to the at least one top panel, at least one bottom end flap foldably connected to the bottom panel, and at least one side end flap foldably connected to the at least one side panel. The carton further includes a handle including a handle strap separable from the at least one top panel and foldably connected to a relief portion, the relief portion being defined by spaced apart cuts in the at least one top end flap, the relief portion for being positioned in a container gap defined by a nested arrangement of the plurality of containers when the handle is activated.

10 Claims, 7 Drawing Sheets

(52) U.S. Cl.
CPC ..... *B65D 2571/00141* (2013.01); *B65D 2571/00462* (2013.01); *B65D 2571/00561* (2013.01)

(58) Field of Classification Search
CPC .. B65D 2571/0066; B65D 2571/00543; B65D 2571/00728; B65D 2571/00851
USPC ..... 206/141
See application file for complete search history.

(56) References Cited

U.S. PATENT DOCUMENTS

| | | | |
|---|---|---|---|
| 2,594,376 | A | 4/1952 | Arneson |
| 2,681,143 | A | 6/1954 | Guyer |
| 2,702,144 | A | 2/1955 | Forrer |
| 2,797,856 | A | 7/1957 | Jaeschke |
| 2,810,506 | A | 10/1957 | Kessler |
| 2,842,304 | A | 7/1958 | Ringler |
| 2,868,433 | A | 1/1959 | Anderson, Jr. |
| 2,955,739 | A | 10/1960 | Collura |
| 3,076,591 | A | 2/1963 | Nute et al. |
| 3,112,856 | A | 12/1963 | MacIntosh et al. |
| 3,127,720 | A | 4/1964 | Gentry et al. |
| 3,204,815 | A | 9/1965 | Weis |
| 3,300,119 | A | 1/1967 | Chaussadas |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |
| 3,828,926 | A | 8/1974 | Rossi |
| 3,886,901 | A | 6/1975 | Zeitter |
| 3,894,681 | A | 7/1975 | Arneson et al. |
| 3,904,036 | A | 9/1975 | Forrer |
| 3,933,303 | A | 1/1976 | Kirby, Jr. |
| 3,994,432 | A | 11/1976 | Kirby, Jr. |
| 4,029,204 | A | 6/1977 | Manizza |
| 4,036,423 | A | 7/1977 | Gordon |
| 4,096,985 | A | 6/1978 | Wood |
| 4,111,306 | A | 9/1978 | Roccaforte |
| 4,216,861 | A | 8/1980 | Oliff |
| 4,318,474 | A | 3/1982 | Hasegawa |
| 4,328,923 | A | 5/1982 | Graser |
| 4,329,923 | A | 5/1982 | Iida |
| 4,331,289 | A | 5/1982 | Killy |
| 4,364,509 | A | 12/1982 | Holley et al. |
| 4,375,258 | A | 3/1983 | Crayne et al. |
| 4,378,905 | A | 4/1983 | Roccaforte |
| 4,382,505 | A | 5/1983 | Sutherland et al. |
| 4,396,143 | A | 8/1983 | Killy |
| 4,418,864 | A | 12/1983 | Nielsen |
| 4,424,901 | A | 1/1984 | Lanier |
| 4,440,340 | A | 4/1984 | Bakx |
| 4,470,503 | A | 9/1984 | Stone |
| 4,478,334 | A | 10/1984 | Graser |
| 4,482,090 | A | 11/1984 | Milliens |
| 4,498,619 | A | 2/1985 | Roccaforte |
| 4,508,258 | A | 4/1985 | Graser |
| 4,538,759 | A | 9/1985 | Dutcher |
| 4,545,485 | A | 10/1985 | Oliff |
| 4,546,914 | A | 10/1985 | Roccaforte |
| 4,577,799 | A | 3/1986 | Oliff |
| 4,588,084 | A | 5/1986 | Holley, Jr. |
| 4,653,686 | A | 3/1987 | Wood et al. |
| 4,706,876 | A | 11/1987 | Wilson |
| 4,747,487 | A | 5/1988 | Wood |
| 4,747,534 | A | 5/1988 | Marie |
| 4,784,266 | A | 11/1988 | Chaussadas |
| 4,784,316 | A | 11/1988 | Crouch |
| 4,802,583 | A | 2/1989 | Calvert et al. |
| 4,830,267 | A | 5/1989 | Wilson |
| 4,875,586 | A | 10/1989 | Chaussadas |
| 4,966,324 | A | 10/1990 | Steel |
| 5,020,337 | A | 6/1991 | Krieg |
| 5,060,792 | A | 10/1991 | Oliff |
| 5,072,876 | A | 12/1991 | Wilson |
| 5,094,359 | A | 3/1992 | DeMars et al. |
| 5,106,014 | A | 4/1992 | Miller |
| 5,119,985 | A | 6/1992 | Dawson et al. |
| 5,197,598 | A | 3/1993 | Stout et al. |
| 5,221,041 | A | 6/1993 | Stout et al. |
| 5,222,658 | A | 6/1993 | DeMaio et al. |
| 5,234,102 | A | 8/1993 | Schuster et al. |
| 5,240,174 | A | 8/1993 | Wenniger |
| 5,246,112 | A | 9/1993 | Stout et al. |
| 5,284,294 | A | 2/1994 | Floyd |
| 5,292,058 | A | 3/1994 | Zoss et al. |
| 5,297,725 | A | 3/1994 | Sutherland |
| 5,303,863 | A | 4/1994 | Arasim |
| 5,307,932 | A | 5/1994 | Stout et al. |
| 5,307,986 | A | 5/1994 | Schuster |
| 5,320,277 | A | 6/1994 | Stout et al. |
| 5,328,081 | A | 7/1994 | Saulas |
| 5,333,734 | A | 8/1994 | Stout et al. |
| D350,480 | S | 9/1994 | Sutherland |
| 5,379,944 | A | 1/1995 | Stout et al. |
| 5,381,891 | A | 1/1995 | Harris |
| 5,385,234 | A | 1/1995 | Stout et al. |
| 5,395,044 | A | 3/1995 | Stout |
| 5,427,241 | A | 6/1995 | Sutherland |
| 5,458,234 | A | 10/1995 | Harris |
| 5,472,090 | A | 12/1995 | Sutherland |
| 5,482,203 | A | 1/1996 | Stout |
| 5,485,915 | A | 1/1996 | Harris |
| 5,495,727 | A | 3/1996 | Strong et al. |
| 5,524,756 | A | 6/1996 | Sutherland |
| 5,551,556 | A | 9/1996 | Sutherland |
| 5,582,343 | A | 12/1996 | Dalvey |
| 5,639,017 | A | 6/1997 | Fogle |
| 5,647,483 | A | 7/1997 | Harris |
| 5,669,500 | A | 9/1997 | Sutherland |
| 5,699,957 | A | 12/1997 | Bin et al. |
| 5,704,470 | A | 1/1998 | Sutherland |
| 5,738,273 | A | 4/1998 | Auclair |
| 5,739,273 | A | 4/1998 | Engelman et al. |
| 5,794,778 | A | 8/1998 | Harris |
| 5,826,782 | A | 10/1998 | Stout |
| 5,873,515 | A | 2/1999 | Dunn et al. |
| 5,878,946 | A | 3/1999 | Frerot et al. |
| 5,906,313 | A | 5/1999 | Oliff |
| 5,915,546 | A | 6/1999 | Harrelson |
| 5,992,733 | A | 11/1999 | Gomes |
| 6,019,276 | A | 2/2000 | Auclair |
| 6,021,897 | A | 2/2000 | Sutherland |
| 6,065,590 | A | 5/2000 | Spivey |
| 6,085,969 | A | 7/2000 | Burgoyne |
| 6,105,853 | A | 8/2000 | Lamare |
| 6,105,854 | A | 8/2000 | Spivey et al. |
| 6,112,977 | A | 9/2000 | Sutherland et al. |
| 6,129,266 | A | 10/2000 | Oliff et al. |
| 6,131,803 | A | 10/2000 | Oliff et al. |
| D433,630 | S | 11/2000 | Lubineau-Bigot |
| 6,164,526 | A | 12/2000 | Dalvey |
| 6,170,741 | B1 | 1/2001 | Skolik et al. |
| 6,227,367 | B1 | 5/2001 | Harrelson et al. |
| 6,260,755 | B1 | 7/2001 | Bates et al. |
| D447,686 | S | 9/2001 | Cattell |
| 6,302,320 | B1 | 10/2001 | Stout |
| 6,371,365 | B1 | 4/2002 | Doucette et al. |
| 6,425,520 | B1 | 7/2002 | Peterson |
| 6,523,739 | B2 | 2/2003 | Heeley et al. |
| 6,536,656 | B2 | 3/2003 | Auclair et al. |
| 6,631,803 | B2 | 10/2003 | Rhodes et al. |
| 6,758,337 | B2 | 7/2004 | Chargueraud et al. |
| 6,766,940 | B2 | 7/2004 | Negelen |
| 6,834,793 | B2 | 12/2004 | Sutherland |
| 6,848,573 | B2 | 2/2005 | Gould et al. |
| 6,869,009 | B2 | 3/2005 | Sutherland et al. |
| D505,620 | S | 5/2005 | Huebsch |
| 6,899,221 | B2 | 5/2005 | Skolik et al. |
| 6,905,066 | B2 | 6/2005 | Holley |
| 6,926,193 | B2 | 8/2005 | Smalley |
| 6,942,140 | B2 * | 9/2005 | Merzeau ..... B65D 71/30 229/117.22 |
| 6,945,450 | B2 | 9/2005 | Rusnock |

(56) References Cited

U.S. PATENT DOCUMENTS

| | | | |
|---|---|---|---|
| 6,968,992 | B2 | 11/2005 | Schuster |
| 7,007,836 | B2 | 3/2006 | Smalley |
| 7,234,596 | B2 | 6/2007 | Lebras |
| 7,296,731 | B2 | 11/2007 | Auclair et al. |
| 7,380,701 | B2 | 6/2008 | Fogle et al. |
| 7,416,109 | B2 | 8/2008 | Sutherland |
| 7,427,010 | B2 | 9/2008 | Sutherland |
| 7,472,791 | B2 | 1/2009 | Spivey, Sr. |
| 7,601,111 | B2 | 10/2009 | Sutherland et al. |
| 7,699,215 | B2 | 4/2010 | Spivey, Sr. |
| 7,743,944 | B2 | 6/2010 | Ho Fung et al. |
| 7,743,968 | B2 | 6/2010 | Theelen |
| 7,748,603 | B2 | 7/2010 | Fogle et al. |
| 7,757,933 | B2 | 7/2010 | Dunn |
| 7,793,779 | B2 | 9/2010 | Spivey, Sr. et al. |
| 7,806,314 | B2 | 10/2010 | Sutherland |
| 8,191,761 | B2 | 6/2012 | Brand |
| D668,949 | S | 10/2012 | Hipperson |
| 8,459,533 | B2 | 6/2013 | Requena et al. |
| D685,264 | S | 7/2013 | Lal |
| D696,107 | S | 12/2013 | Kimple |
| D706,128 | S | 6/2014 | Strom |
| 8,740,051 | B2 | 6/2014 | Gonzalez |
| 8,840,009 | B2 | 9/2014 | Spivey, Sr. et al. |
| D721,575 | S | 1/2015 | Paboojian |
| 8,955,736 | B2 | 2/2015 | Spivey, Sr. et al. |
| 8,978,963 | B2 | 3/2015 | Kastanek et al. |
| 9,010,620 | B2 | 4/2015 | Sutherland et al. |
| 9,033,209 | B2 | 5/2015 | Fogle et al. |
| D747,646 | S | 1/2016 | Sanfilippo |
| 9,376,244 | B2 | 6/2016 | Kastanek et al. |
| D768,475 | S | 10/2016 | Thompson |
| D778,721 | S | 2/2017 | Sanfilippo |
| 9,598,202 | B2 | 3/2017 | Oliveira et al. |
| 9,656,789 | B2 | 5/2017 | Requena |
| D826,707 | S | 8/2018 | Sanfilippo |
| D826,711 | S | 8/2018 | Boersma et al. |
| D830,199 | S | 10/2018 | Ogata |
| 10,202,228 | B2 | 2/2019 | Boersma et al. |
| 10,421,576 | B2 | 9/2019 | Couture |
| D867,900 | S | 11/2019 | Thompson et al. |
| D881,690 | S | 4/2020 | Smalley |
| D887,831 | S | 6/2020 | Boersma et al. |
| D887,832 | S | 6/2020 | Boersma et al. |
| D925,350 | S | 7/2021 | Mezzalira |
| D934,064 | S | 10/2021 | Satnick |
| 2001/0017314 | A1 | 8/2001 | Boukredine et al. |
| 2003/0006158 | A1 | 1/2003 | Skolik et al. |
| 2003/0015579 | A1 | 1/2003 | LeBras et al. |
| 2003/0213263 | A1 | 11/2003 | Woog |
| 2004/0050917 | A1 | 3/2004 | Smalley |
| 2004/0074954 | A1 | 4/2004 | Fogle et al. |
| 2005/0056658 | A1 | 3/2005 | Spivey |
| 2005/0087592 | A1 | 4/2005 | Schuster |
| 2005/0109827 | A1 | 5/2005 | Martin |
| 2005/0167478 | A1 | 8/2005 | Holley, Jr. |
| 2005/0247767 | A1 | 11/2005 | Smalley |
| 2006/0071058 | A1 | 4/2006 | Spivey, Sr. |
| 2006/0169755 | A1 | 8/2006 | Spivey, Sr. |
| 2006/0273143 | A1 | 12/2006 | Finch |
| 2007/0039846 | A1 | 2/2007 | Spivey, Sr. |
| 2007/0051781 | A1 | 3/2007 | Holley, Jr. |
| 2007/0095882 | A1 | 5/2007 | Holley, Jr. |
| 2007/0108261 | A1 | 5/2007 | Schuster |
| 2007/0164091 | A1 | 7/2007 | Fogle et al. |
| 2007/0181658 | A1 | 8/2007 | Sutherland |
| 2007/0205255 | A1 | 9/2007 | Dunn |
| 2007/0272184 | A1 | 11/2007 | Rommel |
| 2007/0295789 | A1 | 12/2007 | Ho Fung |
| 2008/0048014 | A1 | 2/2008 | Bates |
| 2008/0099544 | A1 | 5/2008 | Skolik |
| 2008/0119344 | A1 | 5/2008 | Sutherland et al. |
| 2009/0014508 | A1 | 1/2009 | Marie |
| 2009/0236408 | A1 | 9/2009 | Spivey, Sr. |
| 2009/0255983 | A1 | 10/2009 | De Paula et al. |
| 2010/0213249 | A1 | 8/2010 | Requena |
| 2012/0012600 | A1 | 1/2012 | Gonzalez |
| 2012/0211552 | A1 | 8/2012 | Kastanek et al. |
| 2013/0214036 | A1 | 8/2013 | Spivey, Sr. |
| 2014/0151444 | A1 | 6/2014 | Fogle |
| 2014/0238882 | A1 | 8/2014 | Requena |
| 2015/0251828 | A1 | 9/2015 | Spivey, Sr. |
| 2017/0008662 | A1 | 1/2017 | Loftin |
| 2017/0137165 | A1* | 5/2017 | Holley, Jr. ..... B65D 5/10 |
| 2018/0029745 | A1 | 2/2018 | Angulo |
| 2020/0024045 | A1 | 1/2020 | Smalley |
| 2020/0108988 | A1 | 4/2020 | Thompson |
| 2021/0269192 | A1 | 9/2021 | Thompson |
| 2021/0362926 | A1 | 11/2021 | Gonzalez Manzano |

FOREIGN PATENT DOCUMENTS

| | | |
|---|---|---|
| CA | 2 160 145 | 9/1995 |
| DE | 85 14 718.4 | 6/1985 |
| DE | 296 07 374 | 4/1996 |
| DE | 201 12 228 | 11/2002 |
| DE | 2004 018 649 | 4/2005 |
| EP | 0 341 089 | 11/1989 |
| EP | 0 412 226 | 2/1991 |
| EP | 0 473 266 | 3/1992 |
| EP | 0 754 631 | 1/1997 |
| EP | 1 612 157 | 1/2006 |
| EP | 2 310 290 B1 | 6/2012 |
| FR | 1 494 239 | 9/1967 |
| FR | 2 481 231 | 10/1981 |
| FR | 2 579 175 | 9/1986 |
| GB | 2 206 565 | 1/1989 |
| GB | 2 422 819 | 8/2006 |
| JP | 8503187 | 4/1996 |
| JP | 2005507831 | 3/2005 |
| KR | 20-0356729 | 7/2004 |
| WO | WO 99/28207 A1 | 6/1990 |
| WO | WO 94/10047 | 5/1994 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/27538 | 9/1996 |
| WO | WO 97/44253 | 11/1997 |
| WO | WO 99/28207 | 6/1999 |
| WO | WO 00/20288 | 4/2000 |
| WO | WO 00/78618 | 12/2000 |
| WO | WO 01/19690 A1 | 3/2001 |
| WO | WO 01/66434 | 9/2001 |
| WO | WO 02/36440 | 5/2002 |
| WO | WO 03/037742 | 5/2003 |
| WO | WO 2005/080218 | 9/2005 |
| WO | WO 2005/123532 | 12/2005 |
| WO | WO 2006/084009 | 8/2006 |
| WO | WO 2007/089282 | 8/2007 |
| WO | WO 2010/014862 | 2/2010 |

OTHER PUBLICATIONS

SelfPackaging. Carrying case box with handle. Publication date unavailable. Visited Jan. 6, 2022. https://selfpackaging.com/ cardboard-boxes/2504-carrying-case-box-with-handle-4185.html (Year: 0).

Delkor. Nested Shelf Ready Packages. Publication date unavailable. Visited Jan. 6, 2022. https://www.delkorsystems.com/caseload (Year: 0).

Bennett. Shelf-Ready Packaging. Publication date unavailable. Visited Jan. 6, 2022. https://bpkc.com/products/retail-packaging/ shelf-ready-packaging/ (Year: 0).

Packaging Europe. Coca-Cola HBC rolls out paper-based carton solutions to larger multipacks. Published Aug. 18, 2021. Visited Jan. 6, 2022. https://packagingeurope.com/coca-cola-hbc-rolls-out-paper-based-cartonolution/ (Year: 2021).

* cited by examiner

CARTON FOR CONTAINERS

CROSS-REFERENCE TO RELATED APPLICATION

This application claims the benefit of U.S. Provisional Patent Application No. 63/028,628, filed on May 22, 2020.

INCORPORATION BY REFERENCE

The disclosure of U.S. Provisional Patent Application No. 63/028,628, filed on May 22, 2020, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons configured to receive containers in a nested arrangement.

SUMMARY OF THE DISCLOSURE

According to one aspect, the disclosure is generally directed to a carton for containing a plurality of containers in a nested arrangement, the carton comprising a plurality of panels extending at least partially around an interior of the carton, the plurality of panels comprising a bottom panel, at least one top panel, and at least one side panel, and a plurality of end flaps foldably connected to respective panels of the plurality of panels and at least partially closing at least one end of the carton, the plurality of end flaps comprising at least one top end flap foldably connected to the at least one top panel, at least one bottom end flap foldably connected to the bottom panel, and at least one side end flap foldably connected to the at least one side panel. The carton further comprises a handle including a handle strap separable from the at least one top panel and foldably connected to a relief portion, the relief portion being defined by spaced apart cuts in the at least one top end flap, the relief portion for being positioned in a container gap defined by the nested arrangement of the plurality of containers when the handle is activated.

According to another aspect, the disclosure is generally directed to a blank for forming a carton for containing a plurality of containers in a nested arrangement, the blank comprising a plurality of panels for extending at least partially around an interior of the carton formed from the blank, the plurality of panels comprising a bottom panel, at least one top panel, and at least one side panel, and a plurality of end flaps foldably connected to respective panels of the plurality of panels for at least partially closing at least one end of the carton formed from the blank, the plurality of end flaps comprising at least one top end flap foldably connected to the at least one top panel, at least one bottom end flap foldably connected to the bottom panel, and at least one side end flap foldably connected to the at least one side panel. The blank further comprises a handle including a handle strap separable from the at least one top panel and foldably connected to a relief portion, the relief portion being defined by a spaced apart cuts in the at least one top end flap, the relief portion for being positioned in a container gap defined by the nested arrangement of the plurality of containers when the carton is formed from the blank and the handle is activated.

According to another aspect, the disclosure is generally directed to a method of forming a carton for containing a plurality of containers in a nested arrangement, the method comprising obtaining a blank comprising a plurality of panels comprising a bottom panel, at least one top panel, and at least one side panel, a plurality of end flaps foldably connected to respective panels of the plurality of panels and comprising at least one top end flap foldably connected to the at least one top panel, at least one bottom end flap foldably connected to the bottom panel, and at least one side end flap foldably connected to the at least one side panel, and a handle comprising a handle strap separable from the at least one top panel and foldably connected to a relief portion, the relief portion being defined by spaced apart cuts in the at least one top end flap. The method further comprises folding the plurality of panels at least partially around an interior of the carton, folding the plurality of end flaps to at least partially close at least one end of the carton, and activating the handle comprising lifting the handle strap such that the relief portion is positioned in a container gap defined by the nested arrangement of the plurality of containers.

According to another aspect, the disclosure is generally directed to a package, the package comprising a carton, the carton comprising a plurality of panels extending at least partially around an interior of the carton, the plurality of panels comprising a bottom panel, at least one top panel, and at least one side panel, and a plurality of end flaps foldably connected to respective panels of the plurality of panels and at least partially closing at least one end of the carton, the plurality of end flaps comprising at least one top end flap foldably connected to the at least one top panel, at least one bottom end flap foldably connected to the bottom panel, and at least one side end flap foldably connected to the at least one side panel. The carton further comprises a handle including a handle strap separable from the at least one top panel and foldably connected to a relief portion, the relief portion being defined by spaced apart cuts in the at least one top end flap. The package further comprises a plurality of containers in a nested arrangement in the interior of the carton and defining a container gap, the relief portion for being positioned in the container gap when the handle is activated.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to cartons that contain articles, for example, containers such as bottles, cans, etc. The articles can be used, for example, for packaging food and beverage products. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape.

For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

As described herein, cartons may be formed by multiple overlapping panels and/or end flaps. Such panels and/or end flaps may be designated in relative terms to one another, e.g., "first", "second", "third", etc., in sequential or non-sequential reference, without departing from the disclosure.

Figure 1:
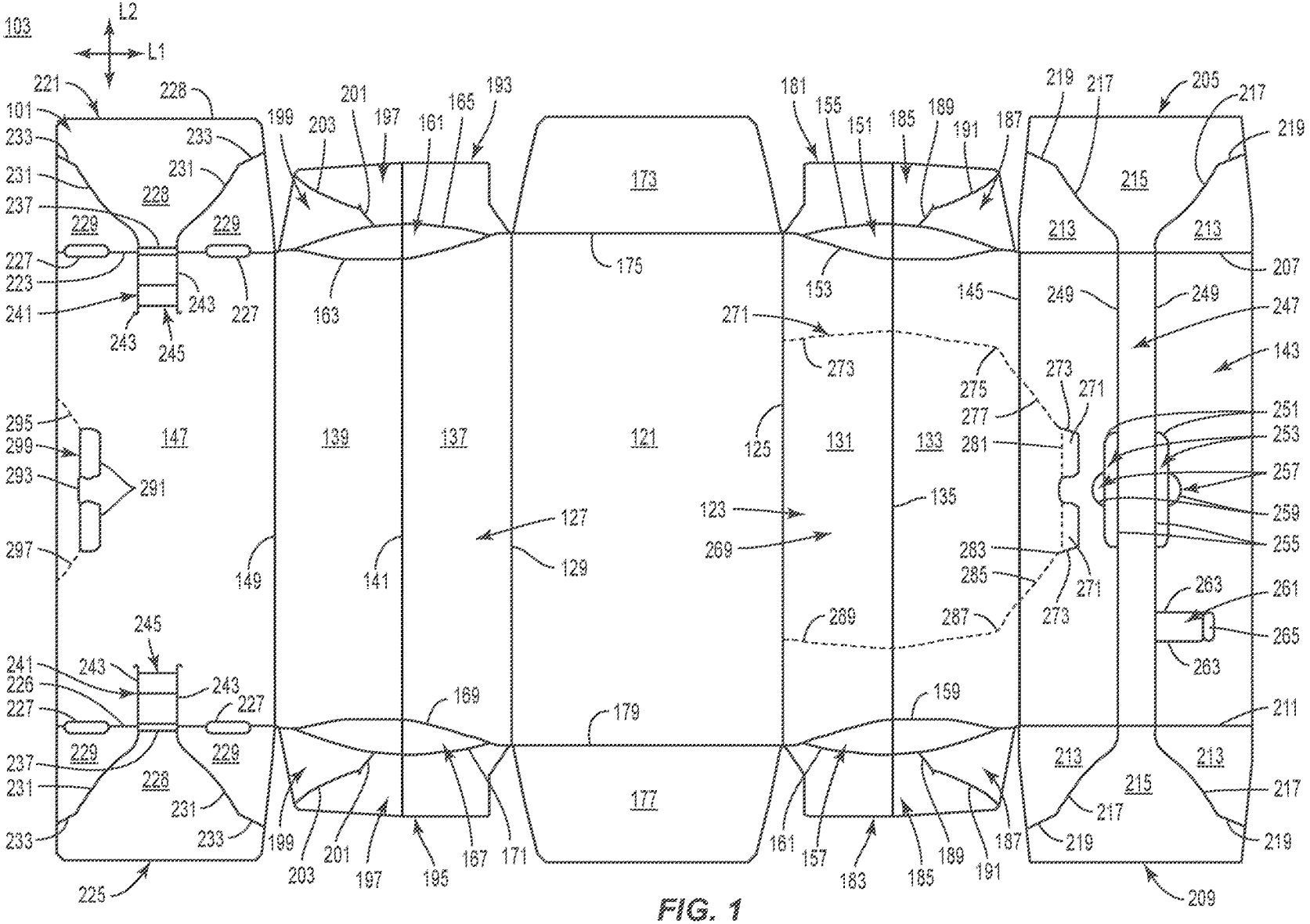
FIG. 1 is a schematic plan view of an exterior surface of a blank for forming a carton according to an exemplary embodiment of the disclosure.
Figure 2:
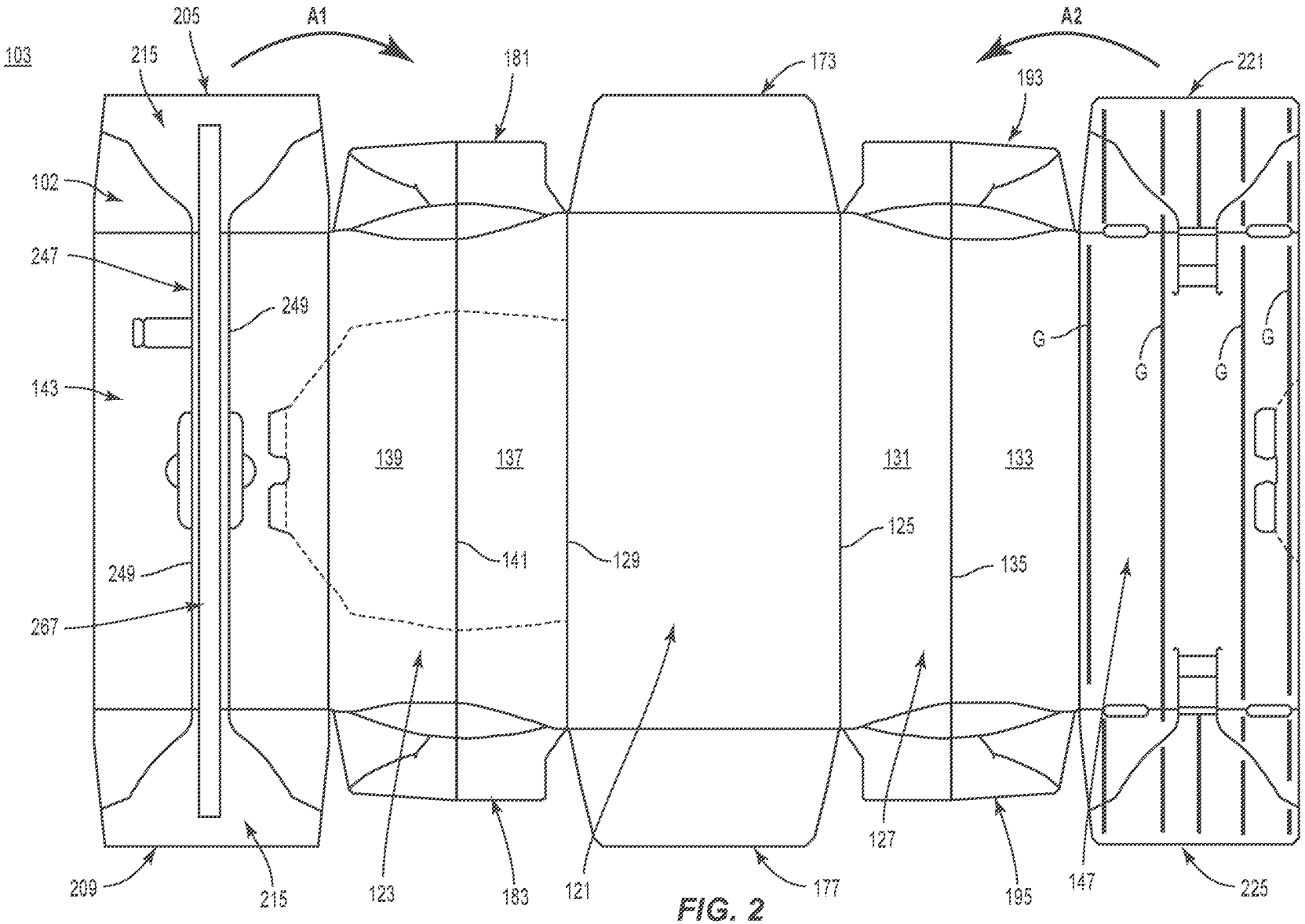
FIG. 2 is a plan view of the interior surface of the blank of FIG. 1.
Figure 3:
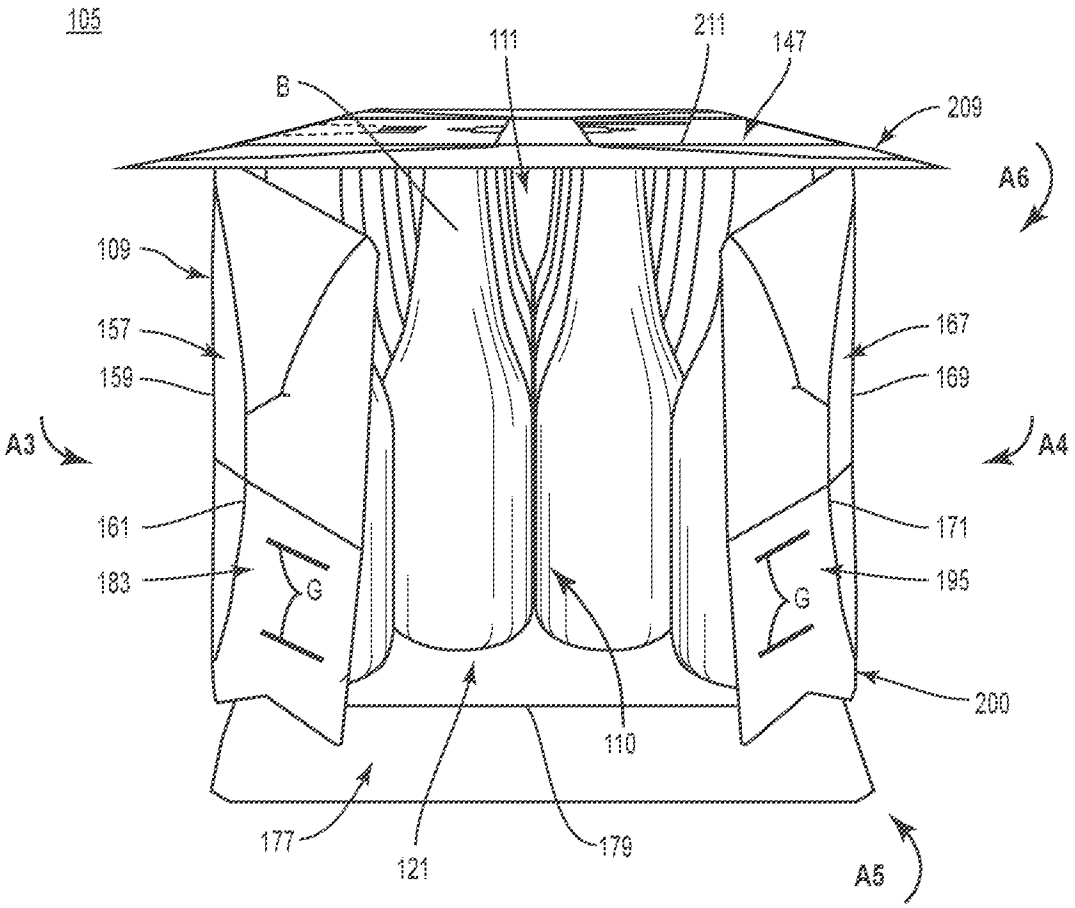
FIG. 3 is a plan view of a carton with open ends formed from the blank of FIG. 1 according to the exemplary embodiment of the disclosure.
Figure 4:
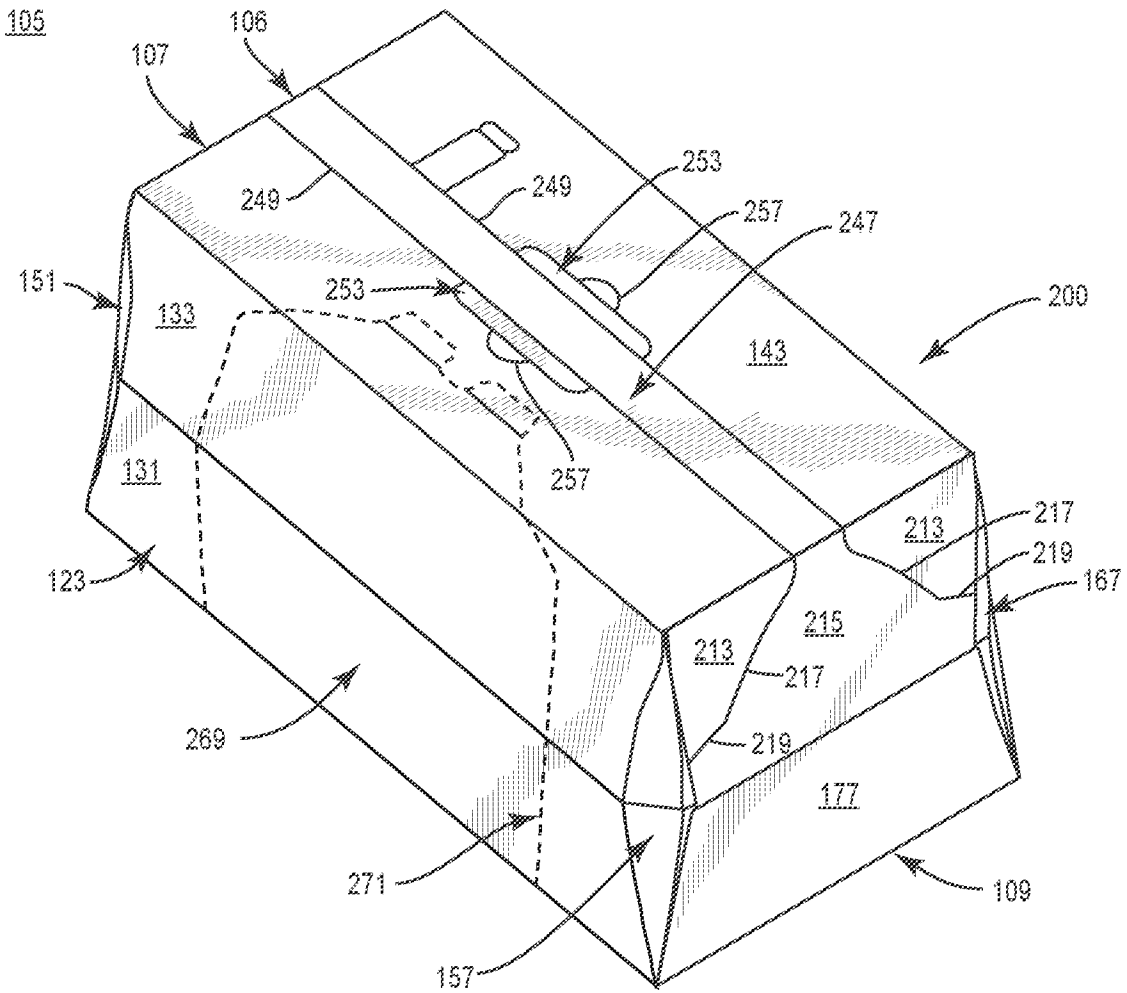
FIG. 4 is a perspective view of the carton of FIG. 3 with closed ends.

FIG. 1 shows a plan view of the exterior surface 101 of a blank, generally indicated at 103, that can be obtained to form a carton 105 (FIG. 4) according to one exemplary embodiment of the disclosure. FIG. 2 shows a plan view of the interior surface 102 of the blank 103. The carton 105 can be used to house a plurality of articles such as containers in the form of beverage bottles B (FIG. 3). As described herein, the carton 105 is provided with a handle 106 having relief features for distributing forces associated with lifting and/or carrying the carton 105.

It will be understood that various nested pack arrangements of containers can be used with the carton 105 or other cartons of the disclosure, which include various arrangements for cans or other containers, such as bottles B. In one embodiment, a fully nested arrangement of containers can have at least one outer row and at least one inner row, wherein each of the inner row(s) can have at least one more container than an outer row. For example, a nested arrangement can have six bottles B in each of two outer rows and seven bottles B in each of two inner rows, wherein each of the outer rows is nested with a respectively adjacent inner row. In one embodiment, an "inverted" or "internal" nesting arrangements can include one or more interior rows of bottles B or cans that are generally shorter than the outer rows of bottles B or cans. Other nested or non-nested arrangements of the containers including bottles B, cans, or other containers could be provided without departing from the disclosure. As described herein, the carton 105 is configured to hold the an inverted or internal nested arrangement of bottles B having two outer rows of seven bottles B and two inner rows of five bottles B, but the carton 105 can hold a different arrangement of containers without departing from the disclosure.

Figure 7:
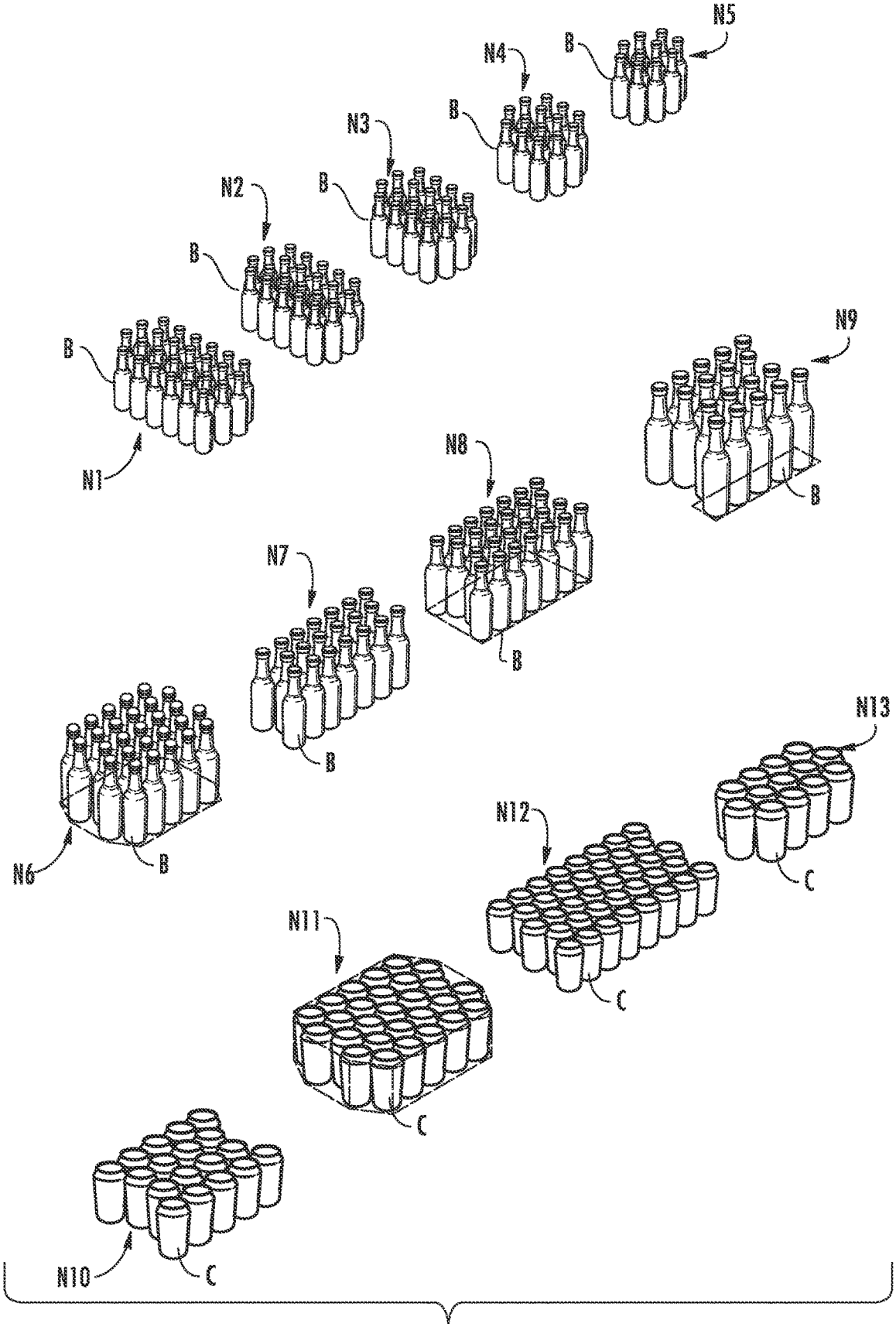
FIG. 7 is a schematic view of various configurations of containers for disposition in a carton according to exemplary embodiments of the disclosure.

Referring momentarily to FIG. 7, various nested pack arrangements of containers for use with carton 105 or other cartons of the disclosure, which include various arrangements for bottles B or other containers such as cans C. The arrangements N1-N5 and N13 and/or other arrangements shown and not shown in the illustrated embodiments can be considered "fully nested" arrangements. In one embodiment, a fully nested arrangement of containers can have at least one outer row and at least one inner row, wherein each of the inner row(s) can have at least one more container than an outer row. For example, nested arrangement N1 can have six bottles B in each of two outer rows and seven bottles B in each of two inner rows, wherein each of the outer rows is nested with a respectively adjacent inner row. In one embodiment, at least the nesting arrangements N6-N12 can be considered "inverted" or "internal" nesting arrangements since one or more of the interior rows of bottles B or cans C are generally shorter than the outer rows of containers B or C. Other nested or non-nested arrangements of the containers including bottles B or cans C could be provided without departing from the disclosure. As described herein, the carton 105 is configured to hold the an inverted or internal nested arrangement of bottles B, but the carton 105 can hold a different arrangement of containers without departing from the disclosure.

Still referring to FIG. 1, the blank 103 has a longitudinal axis L1 and a lateral axis L2. The blank 103 can include a plurality of panels for extending at least partially around an interior 111 of the carton 105 within which the bottles B or other containers or articles can be disposed.

As shown, the panels can include a bottom panel 121 foldably connected to a first side panel 123 at a lateral fold line 125, and the bottom panel 121 is foldably connected to a second side panel 127 at a lateral fold line 129. The first side panel 123 can include a lower portion 131 foldably connected to an upper portion 133 at a lateral fold line 135 that bisects the first side panel 123. Similarly, the second side panel 127 can include a lower portion 137 foldably connected to an upper portion 139 at a lateral fold line 141 that bisects the second side panel 127.

As also shown, a first top panel 143 can be foldably connected to the first side panel 123 at a lateral fold line 145, and a second top panel 147 can be foldably connected to the second side panel 127 at a lateral fold line 149.

The blank 103/carton 105 can also include a corner panel 151 (broadly, "first corner panel" or "first end first corner panel") foldably connected to the first side panel 123 at a curved fold line 153, and which is defined between the curved fold line 153 and another curved fold line 155 having endpoints that intersect the respective endpoints of the curved fold line 153. A corner panel 157 (broadly, "first corner panel" or "second end first corner panel") can also be foldably connected to the opposite end of the first side panel 123 at a curved fold line 159, and is defined between the curved fold line 159 and another curved fold line 161 having endpoints that intersect the respective endpoints of the curved fold line 159. As shown, the corner panels 151, 153 can be at least partially bisected by the fold line 135.

Similarly, a corner panel 161 (broadly, "second corner panel" or "first end second corner panel") can be foldably connected to the second side panel 127 at a curved fold line 163 and is defined between the curved fold line 163 and a curved fold line 165 having endpoints that intersect the respective endpoints of the curved fold line 163. A corner panel 167 (broadly "second corner panel" or "second end second corner panel") can also be foldably connected to the opposite end of the second side panel 127 at a curved fold line 169 and defined between the curved fold line 169 and a curved fold line 171 having endpoints that intersect the respective endpoints of the curved fold line 169.

In this regard, the corner panels 151, 157, 161, 167 can be configured as elongate shapes with generally curved sides, e.g., elliptical, oblong, lanceolate, ovate, etc. It will be understood that one or more of the corner panels 151, 157, 161, 167 can have a different shape without departing from the disclosure. For example, one or more of the corner panels could be diamond-shaped, bevel-shaped, square/rectangular, shaped, rounded/curved-shaped, or combinations thereof, without departing from the disclosure.

Still referring to FIG. 1, a plurality of end flaps can be foldably connected to respective panels of the plurality of panels for forming closed ends of the carton 105 formed from the blank 103.

As shown, a bottom end flap 173 (broadly, "first end bottom end flap") can be foldably connected to the bottom panel 121 at a longitudinal fold line 175, and a bottom end flap 177 (broadly, "second end bottom end flap") can be foldably connected to an opposite side of the bottom panel 121 at a longitudinal fold line 179.

A side end flap 181 (broadly, "first side end flap" or "first end first side end flap") can be foldably connected to the curved fold line 155 adjacent the corner panel 151, and a side end flap 183 (broadly, "first side end flap" or "second end first side end flap") can be foldably connected to the curved fold line 161 adjacent the corner panel 157. As shown, each of the side end flaps 181, 183 is bisected by the fold line 135 and includes a respective container retention portion 185 and a respective relief portion 187.

The respective relief portions 187 are defined by a respective fold line 189 that intersects the respective fold lines 155, 161, and a respective cut 191 that extends from an endpoint of the respective fold line 189 to a free edge of the respective end flaps 181, 183. In this regard, the respective relief portions 187 are foldably connected to the respective container retention portions 185 at the respective fold lines 189 and are separable therefrom at respective cuts 191.

Similarly, a side end flap 193 (broadly, "second side end flap" or "first end second side end flap") can be foldably connected to the curved fold line 165 adjacent the corner panel 161, and a side end flap 195 (broadly, "second side end flap" or "second end second side end flap") can be foldably connected to the curved fold line 171 adjacent the corner panel 167. As shown, each of the side end flaps 193, 195 is bisected by the fold line 141 and includes a respective container retention portion 197 and a respective relief portion 199 (broadly, "second relief portion").

The respective relief portions 199 are defined by a respective fold line 201 that intersects the respective fold lines 165, 171, and a respective cut 203 that extends from an endpoint of the respective fold line 201 to a free edge of the respective end flaps 193, 195. In this regard, the respective relief portions 199 are foldably connected to the respective container retention portions 197 at respective fold lines 201 and are separable therefrom at respective cuts 203.

A top end flap 205 (broadly, "first end first top end flap" or "first top end flap") can be foldably connected to the first top panel 143 at a longitudinal fold line 207, and a top end flap 209 (broadly, "first top end flap" or "second end first top end flap") can be foldably connected to the first top panel 143 at a longitudinal fold line 211. As shown, each top end flap 205, 209 includes a relief portion 215 (broadly, "first relief portion") between a pair of container retention portions 213 defined by respective generally obliquely extending cuts 217 that are spaced apart and intersect the respective fold lines 207, 211 and endpoints of respective oblique fold lines 219 that extend to free edges of the respective top end flaps 205, 209. In this regard, the respective relief portions 213 are defined by the respective spaced apart cuts 217 and fold lines 219 and foldably connected to the respective container retention portions 215 at respective fold lines 219, and are separable therefrom and from the remainder of the respective top end flaps 205, 209 at respective cuts 217.

A top end flap 221 (broadly, "second top end flap" or "first end second top end flap") can be foldably connected to the second top panel 147 at a longitudinal fold line 223, and a top end flap 225 (broadly, "second top end flap" or "second end second top end flap") can be foldably connected to the second top panel 147 at a longitudinal fold line 226. The fold lines 223, 226 can be interrupted by a respective pair of longitudinally spaced openings 227. It will be understood that the blank 103/carton 105 can be devoid of one or more of the openings 227 without departing from the disclosure.

As shown, each top end flap 221, 225 can include a relief portion 228 positioned between a respective pair of container retention portions 229 defined by a respective generally obliquely extending cuts 231 that are spaced apart and intersect the respective fold lines 223, 225 and endpoints of respective oblique fold lines 233 that extend to free edges of the respective top end flaps 221, 225. In this regard, the relief portions 228 are foldably connected to respective container retention portions 229 at respective fold lines 233 and are separable therefrom at respective cuts 231.

In one embodiment, the relief portions 228 of the top end flaps 221, 225 are defined by the spaced apart cuts 231 and fold lines 233 and are foldably connected to a respective relief strip 241 at a respective longitudinal fold line 237. The relief strip 241 can be defined between a pair of cuts 243 extending from the fold line 237 so as to be separable from the top panel 147. Each relief strip 241 can include a plurality of spaced longitudinal fold lines 245 disposed therealong intersecting the respective cuts 243. It will be understood that the relief strips 241 can have a different configuration, e.g., a different configuration of fold lines, without departing from the disclosure. In one embodiment, the blank 103 and the carton 105 formed therefrom can be devoid of the relief strips 241, and in one example, can be replaced with a similarly sized/dimensioned opening.

The blank 103 can include handle features for forming the handle 106 of the carton 105. In the illustrated embodiment, the handle features can include a handle strap 247 defined between a pair of spaced lateral cuts 249 that extend in the first top panel 143 from the fold line 207 to the fold line 211. A pair of elongate curved cuts 251 can intersect the respective cuts 249 to define a pair of handle reinforcement flaps 253 foldably connected to the handle strap 247 at respective lateral fold lines 255 that interrupt the respective cuts 249. Further, a pair of access openings 257 can be defined by curved cuts 259 that interrupt the respective cuts 251. The blank 103 and carton 105 formed therefrom can be devoid of one or more of the aforementioned handle features without departing from the disclosure.

As also shown, a removable strip 261 can be defined between a pair of spaced longitudinal cuts 263 that extend from one of the cuts 249 to a respective opening 265 defined in the top panel 143. In one embodiment, the removable strip 261 can include printed indicia such as a gift token, coupon, rebate, encoded data payload (e.g., two-dimensional barcode or matrix barcode), other redeemable information, or other advertising or promotional information. The blank 103 and the carton 105 formed therefrom can be devoid of the removable strip 261 and associated features without departing from the disclosure. While the removable strip 261 is shown intersecting/adjacent the handle strap 247, it will be understood that the removable strip 261 can be spaced apart from the handle strap 247 without departing from the disclosure.

As shown in FIG. 2, a handle reinforcement strip 267 can be disposed on the interior surface 102 of the blank 103. The handle reinforcement strip 267 can be a length of material, e.g., a length of tape, and can be comprised of a fibrous or other material with sufficient tensile strength to resist tearing under stresses associated with lifting and/or carrying the carton 105 and the bottles B or other articles or containers therein. In this regard, the handle reinforcement strip 267 can be generally aligned with the handle strap 247 on the interior surface 102 of the blank 103, and can extend onto portions of the respective relief portions 215 of the respective top end flaps 205, 209 on the interior surface 102 of the blank 103.

As described further herein, the handle features of the blank 103/carton 105 can include one or more of the handle strap 247, the relief portions 215 of the end flaps 205, 209, the relief portions 228 of the end flaps 221, 225, the handle reinforcement flaps 253, the access openings 257, the opening 265, the handle reinforcement strip 267, and the associated lines of weakening.

Still referring to FIG. 1, the blank 103 can include dispenser features for forming a dispenser 113 of the carton 105 formed from the blank 103.

As shown, a dispenser panel 269 can be defined between the fold line 125 and a tear line 271 having a first section 273 extending from the fold line 125 to a turning point 275 in the first side panel 123, a second section 277 extending from the turning point 275 to a turning point 279 in the first top panel 143, a third section 281 extending from the turning point 275 in the first top panel 143 to a turning point 283 in the first top panel 143, a fourth section 285 extending from the turning point 283 in the first top panel 143 to a turning point 287 in the first side panel 123, and a fifth section 289 extending from the turning point 287 in the first side panel 123 to the fold line 125. One or more of the tear line sections can include oblique, angled, and/or curved portions.

In this regard, the dispenser panel 269 is formed across portions of both the first side panel 123 and the first top panel 143. As also shown, a pair of dispenser tabs 271 is defined by a cut 273 that intersects and partially interrupts the third section 281 of the tear line 271. The blank 103 and carton 105 formed therefrom can be devoid of the aforementioned dispenser features without departing from the disclosure.

Still referring the FIG. 1, a pair of tab openings 291 are formed in the second top panel 147 and joined by a lateral cut 293, and an oblique tear line section 295, 297 extends from each respective tab opening 291 to a free edge of the second top panel 147. As described further herein, the tear line sections 295, 297 define a dispenser panel section 299 for being aligned with a portion of the dispenser panel 269 when the carton 105 is formed from the blank 103.

Referring additionally to FIG. 3, formation of the carton 105 from the blank 103 according to an exemplary embodiment of the disclosure is illustrated and described. The blank 103 can be inverted, e.g., so that the exterior surface 102 of the blank 103 is facing a supporting surface and the interior surface 101 of the blank 103 is facing upward.

The upper section 139 of the second side panel 127 can be folded at the fold line 141 in the direction of the arrow A1 into at least partial face-to-face contact with the lower portion 137 of the second side panel 127 and such that the second top panel 147 is carried into at least partial face-to-face contact with a respective portion of the bottom panel 121.

Simultaneously or thereafter, the upper section 133 of the first side panel 123 can be folded at the fold line 135 in the direction of the arrow A2 into at least partial face-to-face contact with the lower section 131 of the first side panel 123 and such that the first top panel 143 is carried into at least partial face-to-face contact with the second top panel 147. Such a folded arrangement of the carton 105 can be maintained with an adhesive such as glue G.

Thereafter, the carton 105 can be erected such that the overlapping first top panel 143 and second top panel 147 are in spaced generally parallel relation with the bottom panel 121 and such that each of the first side panel 123 and the second side panel 127 extend upwardly from the bottom panel 121 to the respective first top panel 143 and second top panel 147. Such formation of the carton 105 may include folding of the lower sections 131, 137 of the respective first side panel 123 and second side panel 127 upwardly relative to the bottom panel 121 at the respective fold lines 125, 129 and folding of the upper sections 133, 139 of the respective first side panel 123 and second side panel 127 relative to the respective lower sections 131, 137 at the respective fold lines 135, 141.

The aforementioned folding sequence can result in an open sleeve configuration of the carton 105, as illustrated in FIG. 3, in which an interior space 111 of the carton 105 is accessible, for example, to receive a plurality of containers. In the illustrated embodiment, a plurality of bottles B can be provided/loaded/inserted/positioned in an inverted or internal nesting arrangement, in which one or more of the interior rows of bottles B is generally shorter than the outer rows of bottles B so as to define a container gap 110, between the interior rows of bottles B, the outer rows of bottles B, and the ends 107, 109 (broadly, "first end" and "second end", respectively) of the carton 105. In one embodiment, the container gap 110 is a portion of the interior space 111 of the carton 105 where no bottle B is positioned. In the illustrated embodiment, the container gap 110 is adjacent a respective end 107, 109, extends vertically from the overlapped top panels 143, 147 to the bottom panel 121, and is defined by the spacing between the respective end bottle B of a respective row of bottles B and the respective end flaps that form a respective closed end 107, 109 of the carton 105. As described herein, the carton 105 is configured to hold the an inverted or internal nested arrangement of bottles B, but the carton 105 can hold a different arrangement and/or type of containers without departing from the disclosure. The carton 105 can be provided with the bottles B or other containers/articles as a package 200.

With continued reference to FIG. 3, the end 109 of the carton 105 can be closed by folding the corner panels 157, 167 obliquely inwardly at the respective curved fold lines 159, 169 in the direction of the arrows A3, A4. The side end flaps 183, 195 can also be folded at the respective fold lines 161, 171 in the direction of the respective arrows A3, A4.

Simultaneously or thereafter, the bottom end flap 177 upwardly at the fold line 179 in the direction of the arrow A5 into at least partial face-to-face contact with respective portions of the side end flaps 183, 195.

The overlapped top end flaps 209, 225 can then be folded downwardly at the respective overlapped fold lines 211, 226 in the direction of the arrow A6 such that the top end flap 225 is positioned in at least partial face-to-face contact with respective portions of the side end flaps 183, 195 and the bottom end flaps 177, with the top end flap 209 overlapped thereupon. In this regard, the relief portion 215 of the top end flap 209 can be aligned with the relief portion 228 of the top end flap 225, and the top end flap 225 can be aligned with the relief portions 199 of the respective side end flaps 183, 195, and the relief portions 199 can be aligned with the The opposite end 107 of the carton 105 can be closed by overlapping the end flaps 181, 193, 173, 221, 205 in a manner similar to that described above with regard to the end flaps 183, 195, 177, 225, 209.

Figure 5:
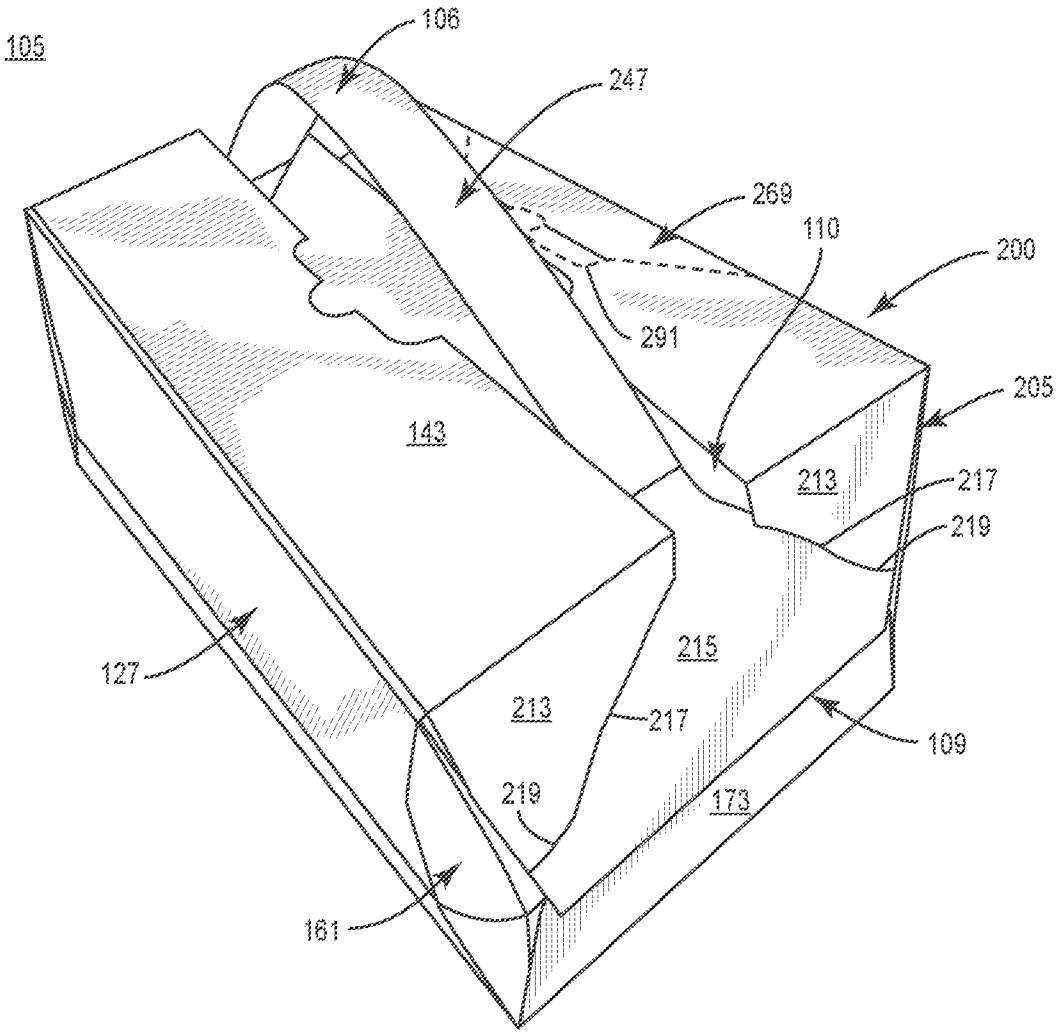
FIG. 5 is a perspective view of the carton of FIG. 4 with a handle thereof being activated.
Figure 6:
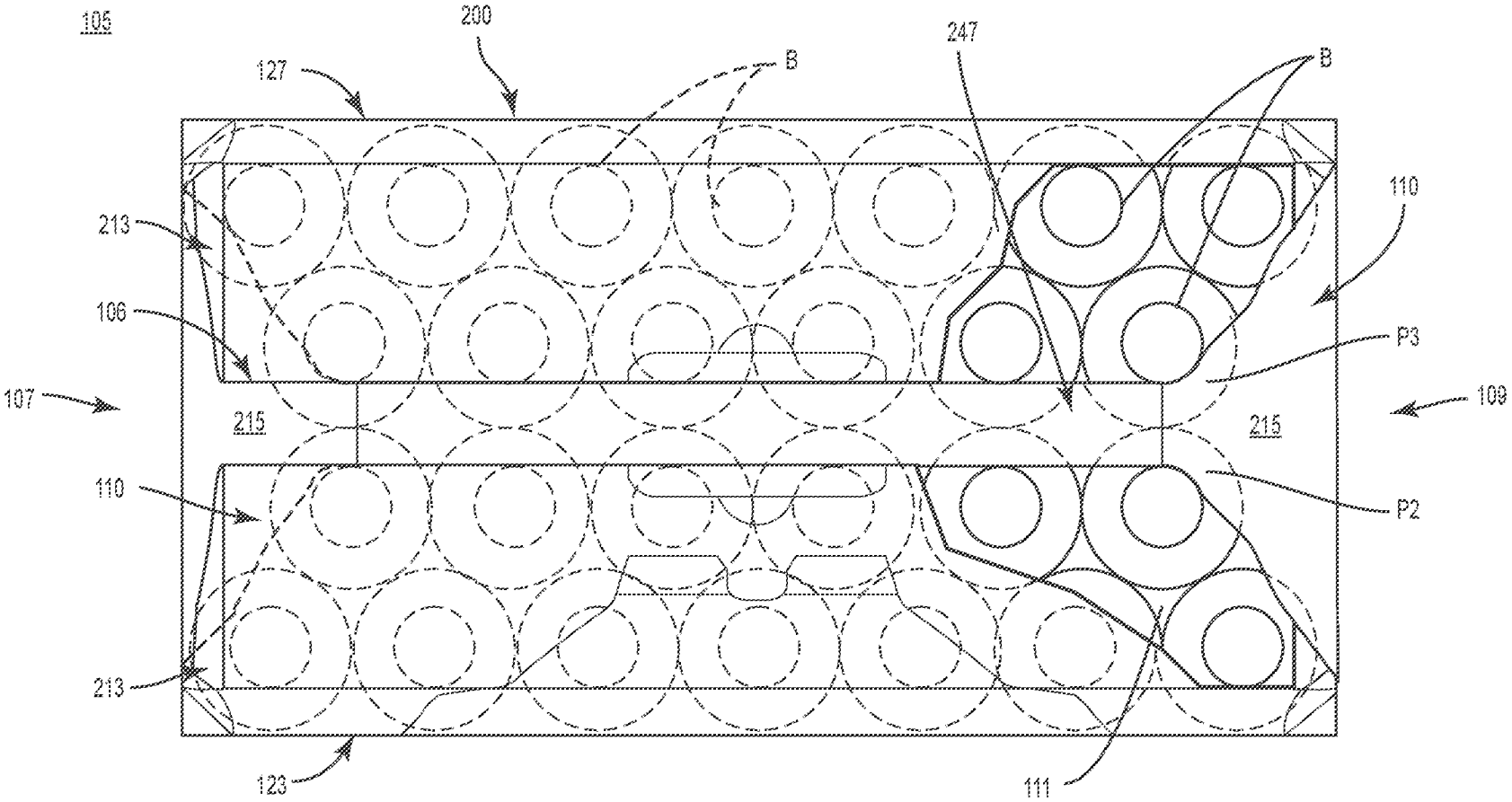
FIG. 6 is a top plan schematic view of the carton as shown in FIG. 5. and having a top portion thereof removed away for clarity.

Referring to FIGS. 5 and 6, operation of the carton 105 including activation of the handle 106 according to one exemplary embodiment of the disclosure will be described and illustrated.

An operator can insert his or her fingers into the handle access openings 259 to grasp an underside of the handle reinforcement flaps 253 and the handle strap 247. In one embodiment, the operator can fold one or both of the handle reinforcement flaps 253 at the respective fold lines 255 into at least partial face-to-face contact with the handle strap 247 to provide cushioning and reinforcement.

Lifting the handle strap 247 and flaps 253 can cause separation of the handle reinforcement flaps 253 from the top panel 143 at the cuts 251 and can cause the handle strap 247 to separate from the top panel 143 at the respective cuts 249.

Additional lifting of the handle 106 can cause handle strap 247 to cause the relief strips 241 that are attached, e.g., adhered, to the underside of the handle strap 247/handle reinforcement strip 267 to separate from the top panel 147 at the respective cuts 243 and/or to at least partially fold/flex/reconfigure at one or more of the fold lines 245. It will be understood that the handle reinforcement strip 267 is subject to lifting/carrying forces applied to the handle strap 247, and provides tensile reinforcement/resistance to tearing thereto. In one embodiment, the blank 103 and the carton 105 formed therefrom can be devoid of the handle reinforcement strip 267.

Further lifting of the handle 106 can cause the respective relief portions 215 of the respective top end flaps 205, 209 to at least partially separate therefrom at the respective cut line 217, and can cause the relief portions 228 of the respective underlying top end flaps 221, 225 to at least partially separate therefrom at the respective cuts 231 such that the respective relief portions 213, 228 can move inwardly toward the interior 111 of the carton 105 so as to be positioned in the container gap 110 adjacent the respective ends 107, 109 of the carton 105.

Such movement of the relief portions 215, 228 of the respective end flaps 205, 209, 221, 225 can position the relief portions in engagement with the bottles B in the carton 105. For example, the relief portions 228 of the end flaps 221, 225 (and the relief portions 215 of the end flaps 205, 209 overlapped thereupon), can be urged to engage shoulder portions of respective bottles B and extend between respective necks of the respective bottles B extending upwardly from the respective shoulder portions.

Furthermore, the respective relief portions 187, 199 of the respective end flaps 181, 183, 193, 195 can at least partially separate from the respective container retention portions 187, 197 at the respective cuts 191, 203 to be urged inwardly toward the container gap 110 to be positioned therein along with the overlapping/aligned relief portions 215, 228 of the respective end flaps 205, 209, 221, 225. It will be understood that one or more of the cuts 191, 203 can be fold lines or other lines of weakening, e.g., such that the respective 187, 199 fold inwardly toward the container gap 110 at such lines, without departing from the disclosure In this regard, forces applied to the handle 106 in the course of lifting/carrying the carton 105 can be distributed from the handle strap 247 to the respective relief portions 228, 215 in the respective end flaps 221, 225, 205, 209 to distribute such forces therealong, which can minimize undesirable stress and shear on the handle 106.

In addition, the separation of respective relief portions 228, 215 of the respective end flaps 221, 225, 205, 209 therefrom can position the respective relief portions 228, 215 in engagement with portions of the bottles B so as to utilize the containers in the interior 111 of the carton 105 as stress distribution points that can further absorb and distribute stresses applied to the handle 106. Furthermore, the foldable connection of the respective container retention portions 213, 229 to the respective relief portions 228 of the respective top end flaps 205, 209, 221, 225 at the respective fold lines 219, 233 can also cause distribution of stresses associated with carrying and/or lifting the carton 105

For example, as shown, the bottles B adjacent the container gap 110 at the closed end 109 of the carton 105 can present points P1, P2 at which the container retention portions 213, 229 engage the bottles B to distribute stresses associated with carrying/lifting the carton 105 and points P3, P4 at which the relief portions 215, 228 engage the bottles B to distribute stresses associated with carrying/lifting the carton 105. For example, such points could be resting against necks or sloping upper portions of the bottles B.

The dispenser 113 of the carton 105 can be activated, for example, by engagement of one or both of the dispenser tabs 273 by an operator, which can be separated along respective portions of the cut 271 to move into the openings 291 in the second top panel 147 that are aligned with the tabs 273 to provide access to an upper edge of the dispenser panel 269. Thereafter, the operator can at least partially separate the dispenser panel 269 along respective sections of the tear line 271 to access the interior 111 of the carton 105 and the bottles B or other articles/containers disposed therein.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package, comprising:

a carton, the carton comprising:

a plurality of panels extending at least partially around an interior of the carton, the plurality of panels comprising a bottom panel, at least one top panel, and at least one side panel;

a plurality of end flaps foldably connected to respective panels of the plurality of panels and at least partially closing at least one end of the carton, the plurality of end flaps comprising at least one top end flap foldably connected to the at least one top panel, at least one bottom end flap foldably connected to the bottom panel, and at least one side end flap foldably connected to the at least one side panel; and a handle including a handle strap separable from the at least one top panel and foldably connected to a relief portion, the relief portion being defined by spaced apart cuts in the at least one top end flap; and a plurality of containers in a nested arrangement in the interior of the carton and defining a container gap, the relief portion for being positioned in the container gap when the handle is activated.

2. The package of claim 1, wherein the relief portion is separable from the remainder of the at least one top end flap at the spaced apart cuts.

3. The package of claim 2, wherein the handle strap is foldably connected to the relief portion at a fold line, the spaced apart cuts intersecting the fold line.

4. The package of claim 2, wherein the relief portion is a first relief portion, and the at least one side end flap comprises a second relief portion being defined by at least one cut in the at least one side end flap.

5. The package of claim 4, wherein the first relief portion is aligned with the second relief portion such that each of the first relief portion and the second relief portion is for being positioned in the container gap when the handle is activated.

6. The package of claim 4, wherein the at least one top panel is a first top panel, the plurality of panels further comprises a second top panel, the first top panel overlapping the second top panel, the at least one top end flap is an at least one first top end flap foldably connected to the first top panel, and the plurality of end flaps further comprises an at least one second top end flap foldably connected to the second top panel.

7. The package of claim 6, wherein the at least one second top end flap comprises a third relief portion, the third relief portion positioned between and aligned with the first relief portion and the second relief portion such that each of the first relief portion, the second relief portion, and the third relief portion is for being positioned in the container gap when the handle is activated.

8. The package of claim 7, wherein the handle further comprises at least one relief strip separable from the second top panel and aligned with a portion of the handle strap.

9. The package of claim 8, further comprising at least one handle reinforcement flap foldably connected to the handle strap.

10. The package of claim 1, wherein the at least one top panel is a first top panel, the plurality of panels further comprises a second top panel, the at least one top end flap is an at least one first top end flap foldably connected to the first top panel, and the plurality of end flaps further comprises an at least one second top end flap foldably connected to the second top panel, the relief portion is a first relief portion in the at least one first top end flap, the handle further comprises a second relief portion in the at least one second top end flap, the handle further comprises at least one relief strip separable from the second top panel and foldably connected to the second relief portion.

* * * * *